US007549487B2

(12) United States Patent
LeBlanc et al.

(10) Patent No.: US 7,549,487 B2
(45) Date of Patent: Jun. 23, 2009

(54) MANDREL AND BEARING ASSEMBLY FOR DOWNHOLE DRILLING MOTOR

(75) Inventors: Randy LeBlanc, Lafayette, LA (US); Carl LeBlanc, Lafayette, LA (US)

(73) Assignee: Coiled Tubing Rental Tools, Inc., Broussard, LA (US)

( * ) Notice: Subject to any disclaimer, the term of this patent is extended or adjusted under 35 U.S.C. 154(b) by 293 days.

(21) Appl. No.: 11/500,012

(22) Filed: Aug. 7, 2006

(65) Prior Publication Data

US 2008/0029304 A1 Feb. 7, 2008

(51) Int. Cl.
*E21B 4/00* (2006.01)

(52) U.S. Cl. ..... 175/93; 175/107; 384/97

(58) Field of Classification Search ..... 175/93, 175/100, 107; 384/97
See application file for complete search history.

(56) References Cited

U.S. PATENT DOCUMENTS

| | | | | |
|---|---|---|---|---|
| 3,840,080 | A | 10/1974 | Berryman | |
| 4,246,976 | A | 1/1981 | McDonald, Jr. | |
| 4,492,276 | A | 1/1985 | Kamp | |
| 4,772,246 | A | 9/1988 | Wenzel | |
| 5,090,497 | A | 2/1992 | Beimgraben et al. | |
| 5,267,905 | A | 12/1993 | Wenzel et al. | |
| 5,495,900 | A | 3/1996 | Falgout, Sr. | |
| 5,588,818 | A | 12/1996 | Houmand et al. | |
| 5,704,838 | A | 1/1998 | Teale | |
| 6,073,708 | A * | 6/2000 | Brown et al. | 175/93 |
| 6,183,226 | B1 | 2/2001 | Wood et al. | |
| 6,202,762 | B1 * | 3/2001 | Fehr et al. | 175/107 |
| 6,328,119 | B1 * | 12/2001 | Gillis et al. | 175/325.1 |
| 6,905,319 | B2 | 6/2005 | Guo | |
| 6,949,025 | B1 | 9/2005 | Kraus et al. | |
| 7,004,843 | B1 | 2/2006 | Kerstetter | |
| 7,186,182 | B2 | 3/2007 | Wenzel et al. | |

FOREIGN PATENT DOCUMENTS

CA 2058080 11/1997

OTHER PUBLICATIONS

U.S. Appl. No. 12/184,644, filed Aug. 1, 2008, LeBlanc et al.
U.S. Appl. No. 12/196,954, filed Aug. 22, 2008, LeBlanc.

* cited by examiner

*Primary Examiner*—William P Neuder
(74) *Attorney, Agent, or Firm*—Fish & Richardson P.C.

(57) ABSTRACT

A downhole drilling motor beating assembly includes a tubular mandrel adapted to connect to a rotational power output of downhole motor. The bearing assembly includes a mandrel having: an upper end proximal to the downhole motor, a lower end with a pin connection distal from the motor, and a longitudinal passage through the mandrel from the upper end to the lower end. The assembly further includes at least one circumferential ring projecting radially outward from an other surface of the tubular mandrel. The ring has and upper shoulder and a lower shoulder and a radial surface. A circumferential upper thrust bushing contacts the upper shoulder of the ring and a circumferential lower thrust bushing contacts the lower shoulder of the ring. An upper thrust beating contacts the upper thrust bushing and a lower thrust bearing contacts the lower thrust bushing. A tubular bearing housing includes a longitudinal passage from an upper end of the housing to a lower end of the housing. The passage includes a lower portion with an internal diameter adapted to receive the lower end of the mandrel and an upper portion with a larger internal diameter adapted to receive the lower beating and bushing and the outer radial surface of the circumferential ring projecting from the mandrel and the upper bushing and beating.

23 Claims, 5 Drawing Sheets

10
150
108
102
104
106
107
110
114
196
170
190
112
180
70

190
109
180
105
124
109

190
103
180
122
104

190
185
120
180
101
102

196
D4
197
190
202
201
204
200
203
194
193
193
199
198

187
180
D6
185
D5
182
181

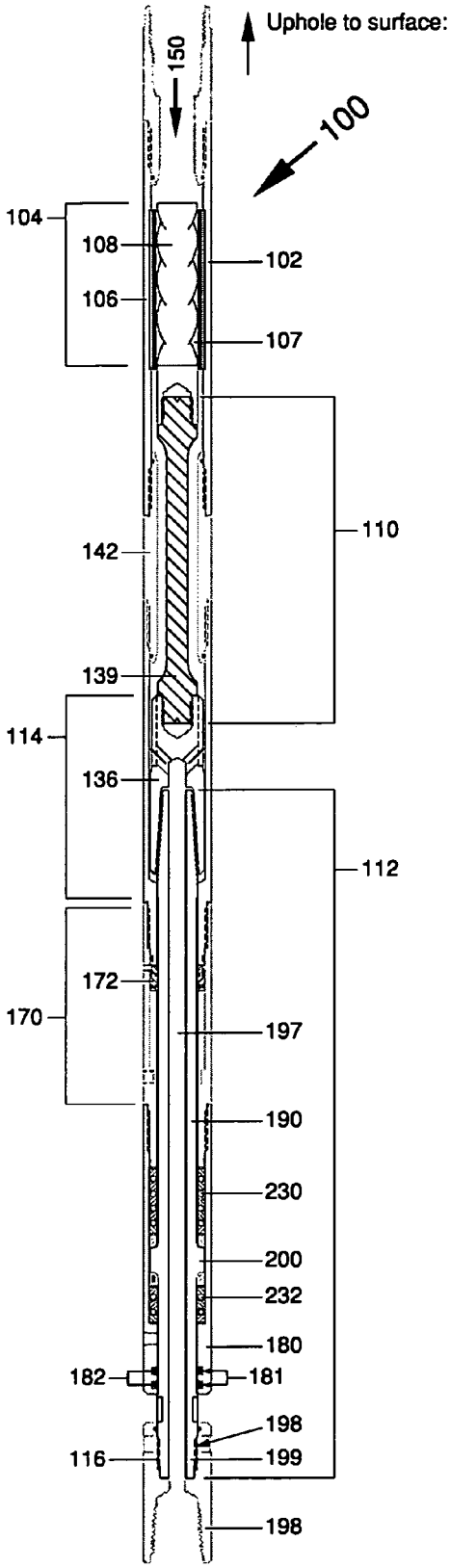
Fig 4A
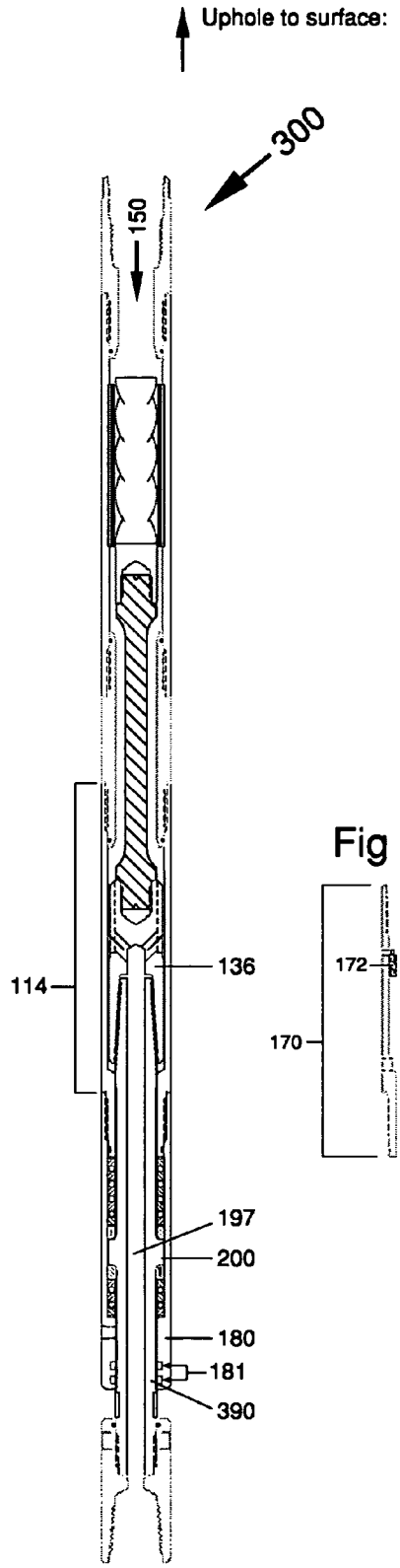
Fig 4B
Fig 4C
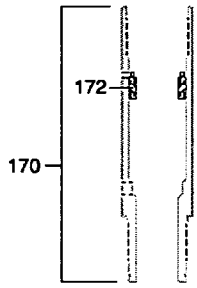
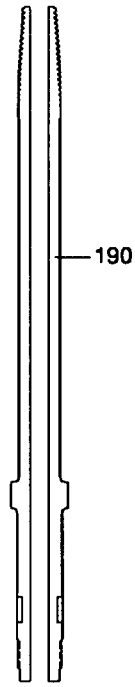
Fig 4D

MANDREL AND BEARING ASSEMBLY FOR DOWNHOLE DRILLING MOTOR

TECHNICAL FIELD

The present invention relates generally to improvements in downhole drilling motors and more particularly pertains to a new improved mandrel and bearing assembly for transmitting power from the motor output to the drill bit.

BACKGROUND

Downhole drilling motors have been used for many years in the drilling of oil and gas wells and other wells. In the usual mode of operation, the rotational power output shaft of the motor and the drill bit will rotate with respect to the housing of the motor. The housing, in turn, is connected to a conventional drill string composed of drill collars and sections of drill pipe. This drill string extends to the surface. Drilling fluid is pumped down through the drill string to the bottom of the hole and back up the annulus between the drill string and the wall of the bore hole. The drilling fluid cools the drill bit and removes the cuttings resulting from the drilling operation. In the instances where the downhole drilling motor is a hydraulic powered type, such as a positive displacement type motor, the drilling fluid also supplies the hydraulic power to operate the motor. See FIG. 1.

Virtually all downhole drilling motors have three basic components:

1. Motor section
2. Vertical thrust bearings
3. Radial bearings

The bearings can be placed in a separate package or unit at the motor section and thus can be used on any type of motor (i.e. turbodrills, positive displacement motors, etc.).

There are two basic type of downhole drilling motors:

1. Turbodrills
2. Positive displacement motors

Turbodrills utilize the momentum change of drilling fluid (i.e. mud) passing through curved turbine blades to provide power to turn the bit. Turbodrills turn at speeds of 600 to 3,000 rpm. Positive displacement motors have fixed volumetric displacement and their speed is directly proportional to the flow rate of the hydraulic power fluid. There are two basic types of positive displacement motors in use:

1. Moineau motors have a helical rotor within the cavity of a stator which is connected to the housing of the motor. As the drilling fluid is pumped down through the motor, the fluid rotates the rotor.
2. Vane motors have large volumetric displacement and therefore deliver higher torques at lower speeds.

Thrust bearing failure in downhole motors is a problem because of high dynamic loads produced by the action of the bits and by drill string vibrations. One major oil company placed a recorder at the hole bottom and found that dynamic loads were often 50% higher than the applied bit weight. It was found on occasion that the bit bounced off bottom and produced loads in excess of 120,000 pounds when drilling at an applied bit weight of 40,000 pounds. See discussion in U.S. Pat. No. 4,246,976, incorporated by reference. These high loads can cause rapid failure of the thrust bearings and bearing mandrels; consequently these bearings must be greatly over designed to operate in the hostile downhole environment.

At least two types of thrust bearings have been used in downhole drilling motors:

1. Rubber friction bearings
2. Ball or roller bearings .

Radial bearings are required between the bearing housing and the rotating mandrel transmitting power from the motor power output to the bit. Radial bearings are usually subjected to lower loads than the thrust bearings and therefore have much longer life. The basic types of radial bearings used in downhole motors are:

1. Marine bearings.
2. Roller or ball bearings.
3. Metal to metal carbide bearings.

Most motors contain marine bearings made of brass, rubber, or similar bearing materials. The marine bearings are frequently lubricated by circulating mud through them. However, some bearing systems are sealed and are lubricated using lubricant (grease) injected into the bearing by a hydraulic piston assembly.

For a further discussion of downhole drilling motors and their operations, see U.S. Pat. Nos. 3,840,080; 4,246,976; 4,492,276 5,495,900; 5,090,497; 6,183,226; 6,905,319 and Canadian Patent No. 2,058,080, incorporated by reference.

SUMMARY

The present invention includes a bearing and mandrel assembly that reduces failure of the mandrel.

The present invention is a downhole drilling motor bearing assembly that includes a tubular mandrel adapted to connect to a rotational power output of a downhole motor. Rotational power=torque×RPM/5250. As used in this document, "tubular" refers to a generally cylindrical member with a longitudinal passage therethrough. The longitudinal passage may be formed therein or bored therethrough. The bearing assembly includes a tubular mandrel having: an upper end proximal to the downhole motor, a lower end with a pin connection distal from the motor, and a longitudinal passage through the mandrel from the upper end to the lower end. The assembly further includes at least one circumferential ring projecting radially outward from an other surface of the tubular mandrel. The ring has an upper shoulder and a lower shoulder and a radial surface. A circumferential upper thrust bushing contacts the upper shoulder of the ring and a circumferential lower thrust bushing contacts the lower shoulder of the ring. An upper thrust bearing contacts the upper thrust bushing and a lower thrust bearing contacts the lower thrust bushing. A tubular bearing housing includes a longitudinal passage from an upper end of the housing to a lower end of the housing. It will be understood the bushings function as a spacer between the thrust bearing and the bearing mandrel ring. The passage includes a lower portion with an internal diameter adapted to receive the lower end of the mandrel and an upper portion with a larger internal diameter adapted to receive the lower bearing and bushing and the outer radial surface of the circumferential ring projecting from the mandrel and the upper bushing and bearing.

The bearing assembly may further include a radial bearing comprising a layer of carbide on at least a portion of the lower portion of the bearing housing and a layer of carbide on at least a portion of the lower end of the mandrel, wherein the layers are adapted to contact one another during rotation of the mandrel within the bearing housing. In a similar manner, the bearing assembly may include an additional radial bearing comprising a layer of carbide on at least a portion of the upper portion of the bearing housing and a layer of carbide on at least a portion of the upper end of the mandrel, wherein said layers are adapted to contact one another during rotation of the mandrel within the bearing housing.

In the illustrated embodiment the circumferential ring is formed integral with the mandrel. However, in alternate embodiments, the circumferential ring may be formed using a separate ring partially received in a circumferential groove on the outer surface of the mandrel or a shrink fit ring or a welded or forged ring. In yet other embodiments, there may be more than one ring. For example, the circumferential ring may comprise an upper ring having an upper shoulder and a lower ring having a lower shoulder. The upper ring is adapted to contact the upper bushing and the lower ring is adapted to contact the lower bushing.

In an embodiment of the invention having a sealed bearing assembly, the device includes at least one seal disposed in the lower portion of the bearing housing proximal to the lower end of the mandrel and a piston sealing assembly disposed proximal to the upper thrust bearing. The piston assembly is adapted to prevent drilling mud from entering into the thrust bearings and adapted to inject lubricant into the bearings.

If the sealing system for the sealed bearing assembly in the sealed bearing embodiment fails during drilling operations, it is possible to continue operating the mandrel and bearing assembly as the drilling mud will pass over the bearings and lubricate them sufficiently to continue operations.

In an alternate embodiment designed with drilling mud lubricated bearings the device includes a fluid flow diverter disposed proximal to the upper end of the mandrel to divert a portion of the drilling mud along the outer surface of the mandrel and across the thrust bearings.

A method of assembling the bearing assembly for a downhole motor is disclosed and includes the steps of inserting the lower end and pin of the bearing mandrel into the upper end of the bearing housing and passing the pin through the longitudinal passage of the bearing housing and out the lower end of the bearing housing until the lower bearing contacts a shoulder in the bearing housing.

A method of converting from a sealed bearing assembly to a mud lubricated bearing assembly includes removing a seal disposed in the lower portion of the bearing housing proximal to the lower end of the mandrel and removing a piston sealing assembly disposed proximal to the upper thrust bearing. The piston assembly being adapted to prevent drilling mud from entering into the bearing and adapted to inject lubricant into the bearings. The tubular bearing mandrel is removed and replaced with a shorter tubular bearing mandrel. After the seal and piston assembly is removed a fluid flow diverter disposed proximal to the upper end of the mandrel diverts a portion of the drilling mud along the outer surface of the mandrel and across the thrust bearings.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 4A is a cross section of the downhole motor and bearing and bearing mandrel of the present invention with an embodiment having a sealed bearing assembly;

FIG. 4B is a cross section of the downhole motor and bearing and bearing mandrel of the present invention with an embodiment having a mud lubricated bearing assembly; and FIG. 4C and 4D are parts that are removed from the embodiment of FIG. 4A to convert the sealed bearing assembly of FIG. 4A to the lubricated bearing assembly of FIG. 4B.

Like reference symbols in the various drawings indicate like elements.

DETAILED DESCRIPTION

Figure 1:
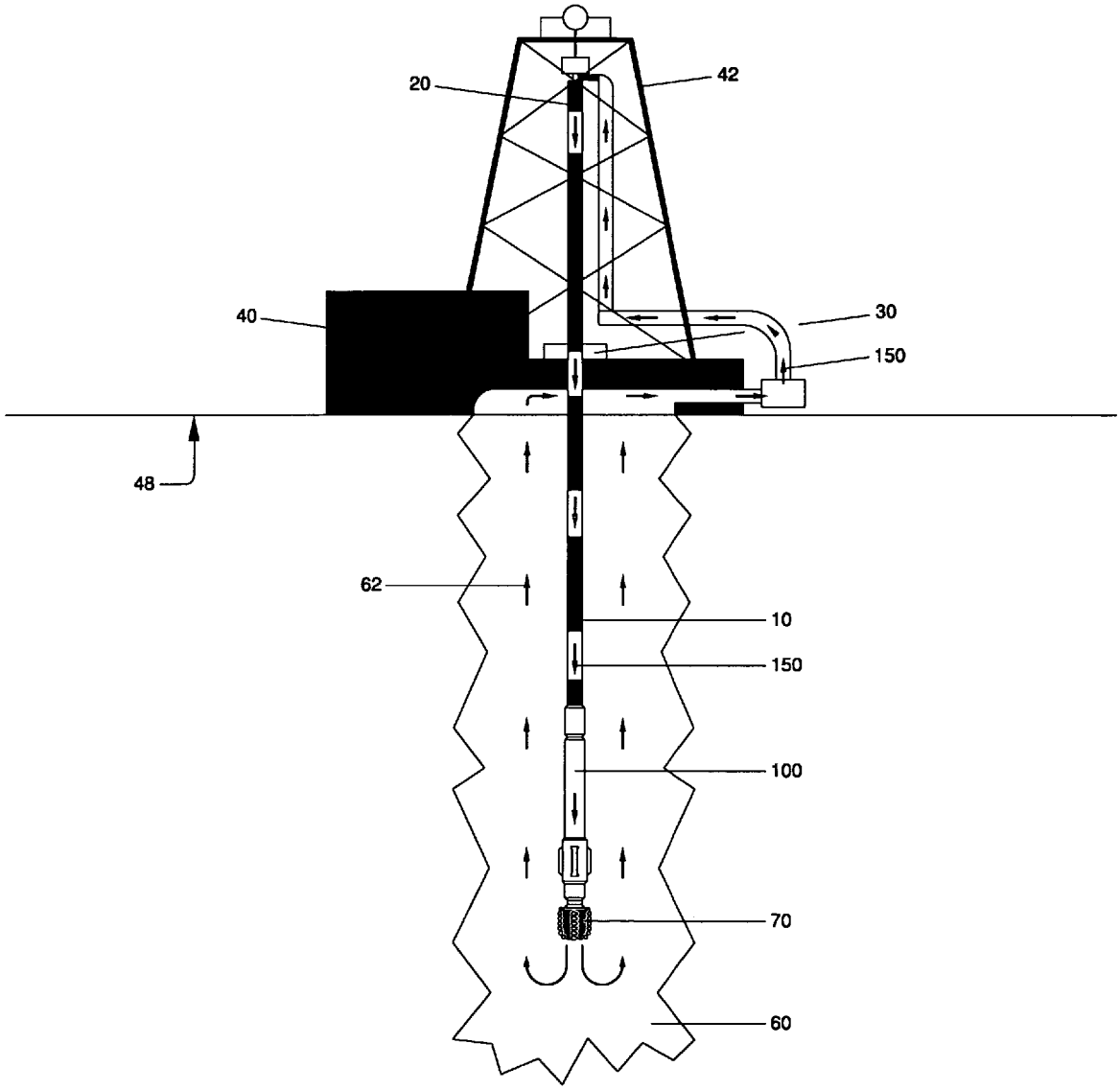
FIG. 1 is a schematic illustrating a typical drilling system using a downhole drilling motor assembly.

FIG. 1 illustrates a simplified schematic of a drilling operation. A drill string 10 extends to the surface 48 where it is connected to a kelly 20, mounted in a rotary table 30 of a drilling rig 40 to provide rotation to the drill string 10 when a downhole motor is not used to provide rotation to the bit. Alternatively, top drive systems are suspended in a rig derrick 42 and provide rotation directly to the drill string 10. Drilling fluid 150 is pumped down through the drill string 10 to the bottom of the bore hole 60 and back up the annulus 62 between the drill string 10 and the wall of the bore hole 60. The drilling fluid cools the drill bit 70 and removes the cuttings resulting from the drilling operation.

In certain drilling situations, including but not limited to directional drilling, it is useful to use a downhole drilling motor assembly 100 to provide rotation to the bit. In such situations the downhole motor assembly 100 is inserted into the drill string 10 above the drill bit 70. In the instances where the downhole drilling motor is a hydraulic type, such as a progressive cavity type motor, the drilling fluid 150 also supplies the hydraulic power to operate the motor.

Various types of downhole drilling motors may be employed for the purpose of the invention such as electrical motors and hydraulic motors. Suitable hydraulic motors are turbines, vane motors and Moineau motors. See discussion in background section of this document about various types of drilling motors.

A Moineau motor is very useful for application in the present invention since this type of motor is provided with a flexible connection between the rotor and power output shaft to compensate the eccentric movement of the rotor in the housing during operation of the motor. The invention is not restricted to the use of a Moineau motor. Any type of downhole motor known in the art may be used with the bearing mandrel and bearing assembly of the present invention.

Figure 2:
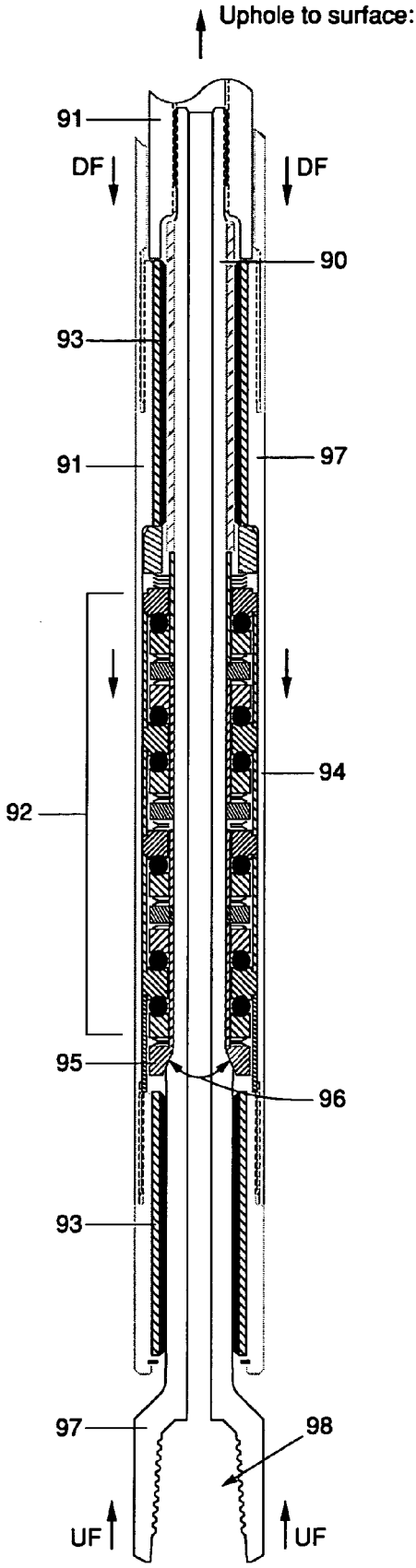
Fig 2 (Prior Art)
FIG. 2 is a cross section of a prior art bearing and bearing mandrel assembly of a prior art downhole motor.

FIG. 2 illustrates a partial cross-section of a prior art downhole motor bearing assembly and bearing mandrel assembly. A downhole drilling motor (not shown) transmits power from the motor power output 91 to a bearing mandrel 90 that contacts radial bearings 93 and thrust bearings 92 housed in a bearing housing 94. The mandrel's distal (lower) end 97 includes a bit box 98 connection for connection to a drill bit. The box connection results in assembly configurations that do not allow the mandrel to be assembled by insertion of the mandrel through the proximal (upper end) 97 of the bearing housing 94. These prior art configurations have mandrels with stepped down profiles 96 on which a bearing spacer 95 makes contact. The stepped down profile of the mandrel results in reduced cross section of mandrel 90 and thereby reduced strength in the mandrel. Failures of the mandrel occur in these reduced cross sectional areas.

As weight is applied on the bit, a downward force DF will move down the drill string through the motor and to the mandrel 90. As mandrel 90 moves downward, bearing spacer 91 will push thrust bearings 92 down. Bearing spacer 95 will contact mandrel 90 at the step down 96. When it does, it will provide weight to the bit to start drilling. An equal and opposite upward force UF will be exerted by the bottom of the bore hole below the bit.

Figure 2A:
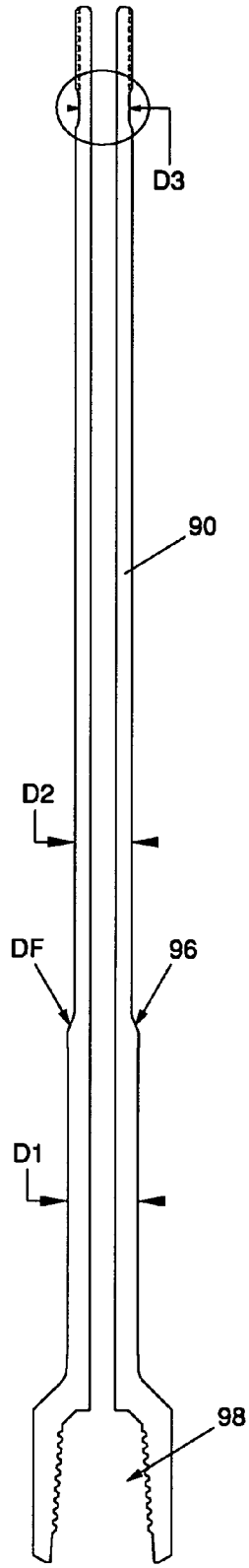
Fig 2A (Prior Art)
FIG. 2A is a cross section of the bearing mandrel of the prior art assembly of FIG. 2.

FIG. 2A illustrates one embodiment of a cross section of the prior art bearing mandrel 90. In an example embodiment, the base diameter D1 of the mandrel is generally 0.89 inch. The reduced cross section diameter D2 is generally 0.68 inch and is stepped down to create a bearing surface 93 for the weight of the drill string to be transmitted to the mandrel. In order to accommodate the thread for the upper pin connection of the bearing mandrel 90 to the motor power output, the mandrel cross section D3 is further reduced to 0.61 inches to accommodate a thread relief on the upper threaded end. These measurements are only representative and for purposes of comparison to the diameter of the mandrel of the present invention. It will be understood that for various size downhole tools these dimensions will change.

Figures 3, 3A, 3B, 3C, 3D, 3E:
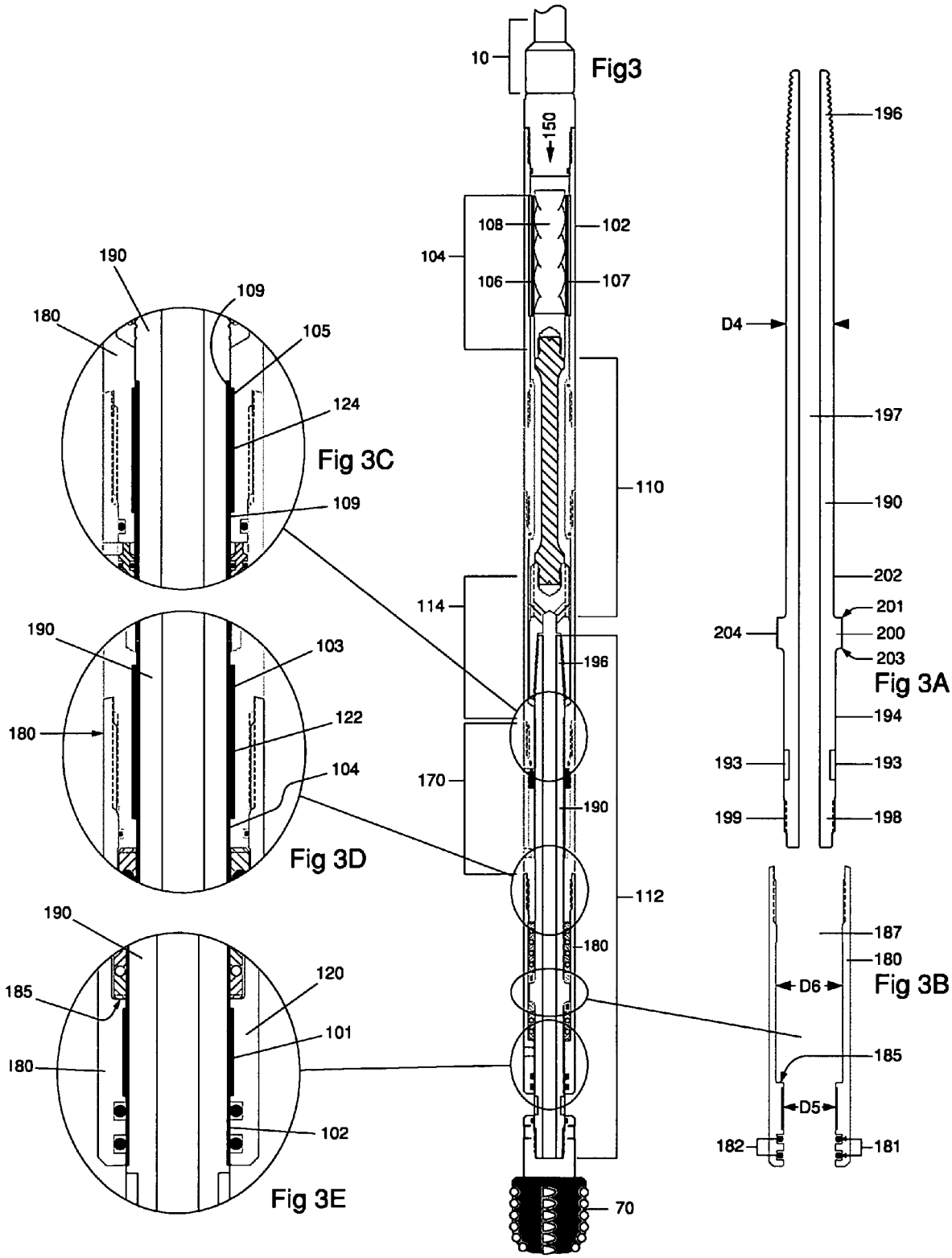
FIG. 3 is a cross section of the downhole motor and bearing and bearing mandrel of one embodiment of the present invention.
FIG. 3A is an enlarged cross section of the bearing mandrel of the bearing assembly of FIG. 3.
FIG. 3B is an enlarged cross section of the bearing housing of the bearing assembly of FIG. 3.
FIGS. 3C, 3D and 3E are enlarged cross sections of the radial bearing assemblies of FIG. 3.

FIG. 3 illustrates a partial cross section of a downhole motor assembly 100 according to one embodiment of the present invention. A downhole motor 104 generally comprises a tubular housing 102 that is preferably formed of steel. Disposed within the tubular housing 102 is a power unit 104 having a stator 106 and a rotor 108 connected to a bearing section assembly 112 via a transmission unit 110. The stator preferably comprises a plurality of lobes defining a cavity 107. It will be understood by those skilled in the art that there may be fewer or more lobes than the 5 illustrated herein. The rotor 108 is operatively positioned in the cavity 107 to cooperate with the plurality of lobes. Applying fluid pressure to the cavity 107 causes the rotor 108 to rotate in cooperation with the lobes in order to allow pressurized drilling fluid 150 that is introduced at an upper end of the motor 100 to be expelled at the lower end and then subsequently exhausted from the bit 70. Rotation of rotor 108 causes bit 70 to rotate.

Referring to both FIGS. 1 and 3, in operation, drilling fluid 150 (also known in the art as drilling mud) 150 is pumped down the interior of a drill string 10 (shown broken away in FIG. 3) attached to downhole drilling motor 104. Drilling fluid 150 enters cavity 107 having a pressure that is a combination of pressure imposed on the drilling fluid by pumps at the surface and the hydrostatic pressure of the above column of drilling fluid 150. The pressurized fluid entering cavity 107, in cooperation with the lobes of the stator 106 and the geometry of the stator 106 and rotor 108 causes the lobes of the stator to deform and the rotor to turn to allow the drilling fluid 150 to pass through the motor 104. Drilling fluid 150 subsequently exits through ports (referred to in the art as jets) in drill bit 70 and travels up the annulus 62 between the bit 70, downhole motor assembly 100 and drill string 10 and is received at the surface 48 where it is captured and pumped down the drill string 10 again.

FIG. 3A is an enlarged cross section of a bearing mandrel 190 of FIG. 3. Referring to FIGS. 3 and 3A, a tubular mandrel 190 contains an upper pin end 196 adapted to connect to a power transmission unit 110 of downhole motor 104. The mandrel 190 further includes a lower end 198 with a pin connection 199, and a longitudinal passage 197 through the mandrel from the upper end to the lower end. As used herein, "tubular" refers to a generally cylindrical member with a longitudinal passage therethrough. The longitudinal passage may be formed therein or bored therethrough. The assembly further includes at least one circumferential ring 200 projecting radially outward from an outer surface 202 of the tubular mandrel 190. The ring has an upper shoulder 201 and a lower shoulder 203 and a radial surface 204. In the illustrated embodiment the circumferential ring is formed integral with the mandrel. However, in alternate embodiments, the circumferential ring may be formed using a separate ring (not illustrated) partially received in a circumferential groove on the outer surface of the mandrel or a shrink fit ring or a welded or forged ring. In yet other embodiments, there may be more than one circumferential ring. For example, an upper ring having an upper shoulder and a lower ring (not illustrated) having a lower shoulder. Wrench flats 193 and 194 are recesses located on the outer surface 202 of the mandrel 190. D4, the outer diameter of bearing mandrel 190 is 1.00 inch. Because the present invention does not have a step down, the mandrel 190 cross section is larger and stronger than prior art bearing mandrels for drilling motors of comparable size.

FIG. 3B is an enlarged cross section of the bearing housing 180. Referring to FIGS. 3 and 3B, a tubular bearing housing 180 includes a longitudinal passage 187 from an upper end of the housing to a lower end of the housing. The passage includes a lower portion with an internal diameter D4 adapted to receive the lower end 198 of the mandrel 190 and an upper portion with a larger internal diameter D5 adapted to receive the outer radial surface 204 of the circumferential ring 200 projecting from the mandrel 190. A shoulder 185 is disposed where the upper D5 and lower D4 internal diameters meet. In a sealed bearing assembly embodiment of the invention, recesses 181 are disposed proximal to the lower end of bearing housing 180 in passage 187. Ring gaskets 182 are inserted therein to form a seal between the bearing housing and the rotating bearing mandrel 190. A piston sealing assembly 170 is disposed proximal to the upper thrust bearing (see FIG. 3F). The piston assembly is adapted to prevent drilling mud from entering into the bearings and adapted to inject lubricant into the bearings. It will be understood other sealing means may be used. Alternatively, in a mud lubricated version of the present invention, the seals may be omitted.

FIGS. 3C, 3D and 3E illustrate the radial bearing assemblies 120, 122 and 124 used in some embodiments of the present invention. The radial bearing assemblies include at least one radial bearing comprising a layer of carbide 101 on at least a portion of the lower portion of the bearing housing and a layer 102 of carbide on at least a portion of the lower end of the mandrel, wherein the layers are adapted to contact one another during rotation of the mandrel 190 within the bearing housing 180. In a similar manner, the bearing assembly may include additional radial bearings 122 and 124 comprising a layer of carbide 103, 105 on at least a portion of the upper portion of the bearing housing and a layer of carbide 104, 109 on at least a portion of the upper end of the mandrel, wherein said layers are adapted to contact one another during rotation of the mandrel within the bearing housing 180. A plurality of radial bearings may increase the stability of the mandrel and bearing assembly in a deviated hole.

Figure 3F:
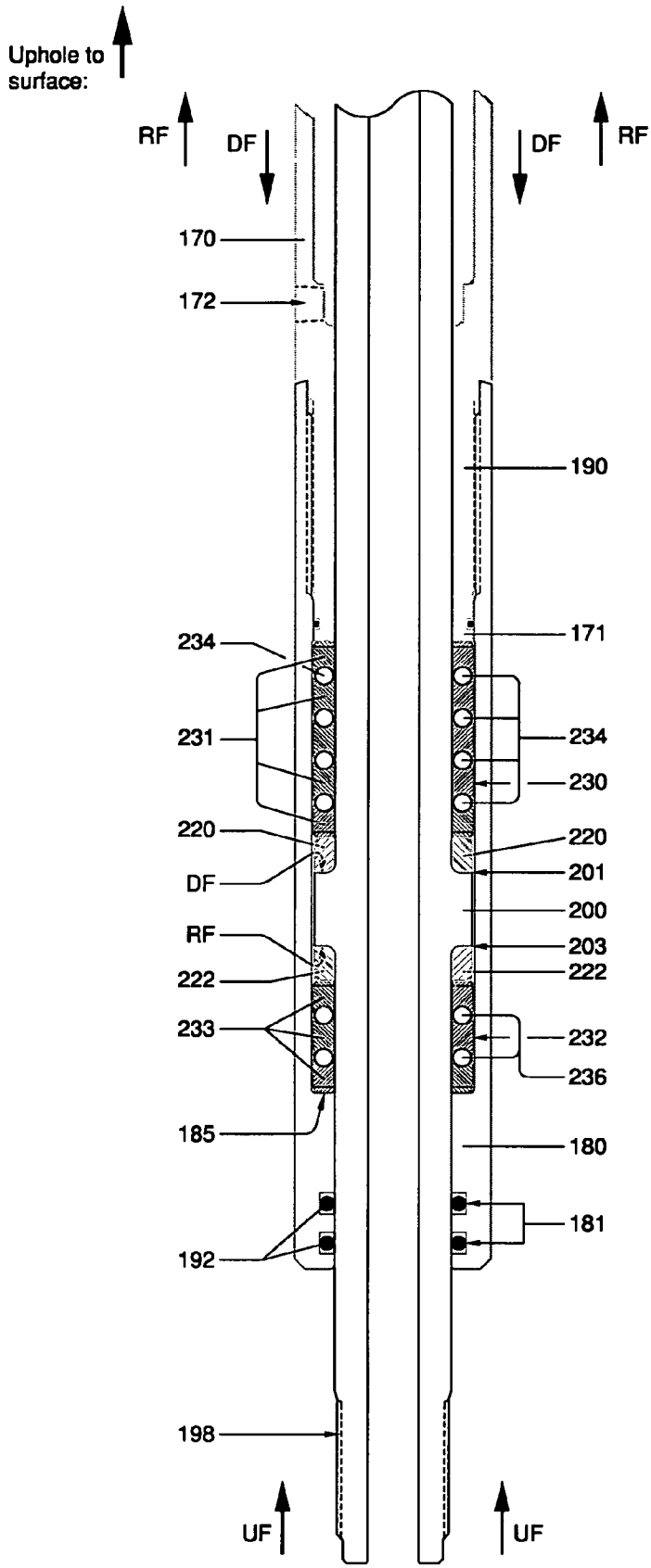
FIG. 3F is an enlarged partial cross section of the bearing mandrel and the bearing housing and thrust bearings of FIGS. 3, 3A and 3B.

FIG. 3F is an enlarged partial cross section showing the bearing mandrel 190 assembled in bearing housing 180. A circumferential upper thrust bushing 220 contacts the upper shoulder 201 of the ring 200 and a circumferential lower thrust bushing 222 contacts the lower shoulder 203 of the ring 200. An upper thrust bearing 230 contacts the upper thrust bushing 220 and a lower thrust bearing 232 contacts the lower thrust bushing 222. Thrust bearings 230 and 232 include a bearing races 231 and 233 and carbide balls 234 and 236. Because the bearing mandrel 190 does not have a bit box on the distal (lower end). 198, the bearing mandrel, may be assembled by standing the mandrel 190 vertical and sliding on the thrust bushings and thrust bearings. Then the lower end 198 of the mandrel 190 is inserted into the upper end of the bearing housing 180 and the lower pin 199 is passed through the longitudinal passage 187 of the bearing housing 180 and out the lower end of the bearing housing until the lower thrust bearing 232 contacts a shoulder 185 in the bearing housing 185. Piston housing 170 is attached to the upper end of the bearing housing. A lower end 171 of the piston housing contacts the upper thrust bearing and secures the bearings 230 and 232 in the bearing housing 180. It will be understood bushings 220 and 222 function as spacers.

The unique design of the ring 200 and shoulder 201 and 203 provide many advantages over the prior art designs. When in drilling operation mode, downward force DF is applied to shoulder 201. When pulling the drill string from the hole, removal force RF is applied to shoulder 203. If during drilling operations the drill string becomes stuck in the bore hole, it is necessary to alternatively pull tension on the drill string and reduce ("slack off") tension on the drill string to "jar" the struck drill string lose form the bore hole. Such jarring operation places additional loads on the bearing system and mandrel. The present invention has a simpler construction and a mandrel cross sectional diameter that is not reduced and is therefore stronger in drilling and jarring operations. The ring 200 shoulders 201 and 203 provide more bearing surface than the prior art design. The present invention also comprises and improve catch assembly for the bearing mandrel. In the unlikely event that the mandrel 190 were to break into two or more parts above the ring 200 cooperates with the shoulder 185 to catch the mandrel 190 and prevents the mandrel from exiting the bearing housing and from being left in the bore hole 60 when the drilling motor assembly 100 and drill string 10 is pulled from the bore hole 60.

Referring now to FIGS. 4A, 4B, 4C and 4D wherein FIG. 4A is a cross section of a sealed bearing assembly embodiment of the downhole motor assembly 100 of the present invention. The parts of FIG. 4A having the same reference numerals as those parts in FIGS. 3, 3A and 3B have similar form and function as the parts in FIGS. 3A and 3B and will not be described herein again. Referring to FIG. 4A, a power transmission unit 110 includes a flexible shaft 139 and a flexible shaft housing 142 that transmit power from the rotor 108 of the downhole motor 104 to the bearings 230, 232 and bearing mandrel 190 assembly 112. A flow diverter 136 and flow diverter housing 114 are threadedly connected to the transmission unit 110. The flow diverter diverts a portion of the drilling mud 150 that has exited the motor section 104, passed around the flexible shaft 139 in the transition section 110 and directs the mud into passage 197 of mandrel 190. Ultimately the mud exits out jets (ports) in the bit (not shown) and is used to cool and lubricate the bit and carry the drill cuttings out of the hole to the surface. In the sealed embodiment of the present invention a piston sealing assembly 170 is disposed below the diverter housing 114 and threadedly attached thereto. The piston assembly 170 is adapted to prevent drilling mud 150 from entering into the bearing assembly and the piston 172 is adapted to inject lubricant into the bearings 230 and 232. If the sealing system for the sealed bearing assembly in the sealed bearing embodiment fails during drilling operations, it is possible to continue operating the mandrel and bearing assembly as the drilling mud will pass over the bearings and lubricate them sufficiently to continue operations Additionally, in the illustrated embodiment of FIG. 4A is a transition sub 116. The transition sub converts the lower pin end 199 of mandrel 190 to a bit box connection 198. In some embodiments a drill bit may have a female box connection in the drill bit and the drill bit may be connected directly to the pin end 199 of the rotating bearing mandrel 190. In other embodiments the transition sub 116 transitions the pin end 199 to a standard bit box 198.

In an alternative embodiment of the present invention, FIG. 4B illustrates a mud lubricated version of the downhole motor bearing assembly 300. Parts having like structure and function to parts of FIG. 4A are assigned like reference numerals. In this embodiment piston seal assembly 170 and piston 172 are removed from the motor assembly 100 (see FIG. 4A and FIGS. 4C and 4D). With the piston seal assembly 170 removed, the fluid flow diverter 136 disposed proximal to the upper end of the mandrel 190 diverts a portion of the drilling mud 150 along the outer surface of the mandrel 190 and across the thrust bearings 230 and 232 and radial bearings 120, 122, 124 and the drilling mud 150 cools and lubricates the bearings.

In order to convert from a sealed bearing assembly 100 to a mud lubricated bearing assembly 300, prior to running the bearing assembly in the borehole, the mandrel 190 is removed and replaced with a shorter version mandrel 390. The piston seal assembly 170 and piston 172 are removed. The lower o-ring seals 182 are removed from recesses 181 of bearing housing 180. The diverter unit 114 is threadedly attached to the bearing housing 180. With the piston seal assembly removed, the fluid flow diverter 136, disposed proximal to the upper end of the mandrel, diverts a portion of the drilling mud along the outer surface of the mandrel 190 and across the thrust bearings 230 and 232 and radial bearings 120, 122, 124.

A number of embodiments of the invention have been described. Nevertheless, it will be understood that various modifications may be made without departing from the spirit and scope of the invention.

What is claimed is:

1. A downhole drilling motor bearing assembly comprising:

a unitary tubular mandrel adapted to connect to a power output of downhole motor, said mandrel having:

an upper end proximal to the downhole motor power output, a lower end with a male pin connector distal from the downhole motor, a longitudinal passage through the mandrel from the upper end to the lower end, at least one circumferential ring projecting radially outward from an outer surface of the tubular mandrel, said ring having an upper shoulder and a lower shoulder and a radial surface;

a circumferential upper thrust bushing contacting the upper shoulder of the ring;

a circumferential lower thrust bushing contacting the lower shoulder of the ring;

an upper thrust bearing contacting the upper thrust bushing;

a lower thrust bearing contacting the lower thrust bushing; and a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the radial surface of the circumferential ring projecting from the mandrel, and said housing adapted to allow the male pin connector of the mandrel to be disposed outside of the lower end of the bearing housing.

2. The bearing assembly of claim 1 wherein the circumferential ring is formed integral with the mandrel.

3. The bearing assembly of claim 1 wherein the circumferential ring comprises a ring partially received in a circumferential groove on the outer surface of the mandrel.

4. The bearing assembly of claim 1 wherein the bearing housing includes a shoulder disposed between the upper portion and lower portion of the housing and said shoulder is adapted to contact the lower thrust bearing.

5. The bearing assembly of claim 1 wherein the circumferential ring is comprised of a first upper ring having an upper shoulder and a second lower ring having a lower shoulder and said first upper ring is adapted to contact the upper bushing and said second lower ring is adapted to contact the lower bushing.

6. The bearing assembly of claim 1 farther including:

at least one seal disposed in the lower portion of the bearing housing proximal to the lower end of the mandrel; and a piston sealing assembly disposed proximal to the upper thrust bearing and adapted to prevent drilling mud from entering into the bearing, and said piston assembly adapted to inject lubricant into the bearings.

7. The bearing assembly of claim 1 wherein the circumferential ring comprises a shrink fit ring received on the outer surface of the bearing mandrel.

8. The bearing assembly of claim 1 wherein the circumferential ring comprises a ring welded onto an outer surface of the bearing mandrel.

9. A downhole drilling motor bearing assembly comprising:

a tubular mandrel adapted to connect to a power output of downhole motor, said mandrel having:

an upper end proximal to the downhole motor power output, a lower end with a pin connection distal from the downhole motor, a longitudinal passage through the mandrel from the upper end to the lower end, at least one circumferential ring projecting radially outward from an outer surface of the tubular mandrel, said ring having an upper shoulder and a lower shoulder and a radial surface;

a circumferential upper thrust bushing contacting the upper shoulder of the ring;

a circumferential lower thrust bushing contacting the lower shoulder of the ring; and at least one radial bearing comprising a layer of carbide on at least a portion of the lower portion of the bearing housing and a layer of carbide on at least a portion of the lower end of the mandrel, wherein said layers are adapted to contact one another during rotation of the mandrel within the bearing housing.

10. The bearing assembly of claim 9 further including:

at least one radial bearing comprising a layer of carbide on at least a portion of the upper portion of the bearing housing and a layer of carbide on at least a portion of the upper end of the mandrel, wherein said layers are adapted to contact one another during rotation of the mandrel within the bearing housing.

11. A downhole drilling motor bearing assembly comprising:

a tubular mandrel adapted to connect to a power output of downhole motor, said mandrel having:

an upper end proximal to the downhole motor power output, a lower end with a pin connection distal from the downhole motor, a longitudinal passage through the mandrel from the upper end to the lower end, at least one circumferential ring projecting radially outward from an outer surface of the tubular mandrel, said ring having an upper shoulder and a lower shoulder and a radial surface;

a circumferential upper thrust bushing contacting the upper shoulder of the ring;

a circumferential lower thrust bushing contacting the lower shoulder of the ring;

an upper thrust bearing contacting the upper thrust bushing;

a lower thrust bearing contacting the lower thrust bushing; and a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the radial surface of the circumferential ring projecting from the mandrel; and a fluid flow diverter disposed proximal to the upper end of the mandrel to divert a portion of the drilling mud along the outer surface of the mandrel and across the thrust bearings.

12. A method of assembling a downhole drilling motor comprising the steps of:

providing a unitary tubular mandrel adapted to connect to a power output of downhole motor, said mandrel having:

an upper end proximal to the downhole motor power output, a lower end with a male pin connector distal from the motor, a longitudinal passage through the mandrel from the upper end to the lower end, at least one circumferential ring projecting radially outward from an outer surface of the tubular mandrel, said ring having an upper shoulder and a lower shoulder and a radial surface;

assembling a circumferential upper thrust bushing in contact with the upper shoulder of the ring;

assembling a circumferential lower thrust bushing in contact with the lower shoulder of the ring;

assembling an upper thrust bearing in contact with the upper thrust bushing;

assembling a lower thrust bearing in contact with the lower thrust bushing;

providing a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the outer radial surface of the circumferential ring projecting from the mandrel; and inserting the lower end of the mandrel into the upper end of the bearing housing and passing the male pin connector through the longitudinal passage of the bearing housing and out the lower end of the bearing housing.

13. A method of assembling a downhole drilling motor comprising the steps of:

providing a unitary tubular mandrel adapted to connect to a power output of downhole motor, said mandrel having:

an upper end proximal to the downhole motor power output, a lower end with a male pin connector distal from the motor, a longitudinal passage through the mandrel from the upper end to the lower end, at least one circumferential ring projecting radially outward from an outer surface of the tubular mandrel, said ring having an upper shoulder and a lower shoulder and a radial surface;

assembling a circumferential upper thrust bushing in contact with the upper shoulder of the ring;

assembling a circumferential lower thrust bushing in contact with the lower shoulder of the ring;

assembling an upper thrust bearing in contact with the upper thrust bushing;

assembling a lower thrust bearing in contact with the lower thrust bushing;

providing a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the outer radial surface of the circumferential ring projecting from the mandrel, said passage having a shoulder disposed between the upper portion and lower portion; and inserting the lower end of the mandrel into the upper end of the bearing housing and passing the male pin connector through the longitudinal passage of the bearing housing and out the lower end of the bearing housing until the lower bearing contacts the shoulder of the bearing housing.

14. A method of converting from a sealed bearing assembly to a mud lubricated bearing assembly prior to disposing the mud lubricated bearing assembly in a borehole comprising the steps of:

providing an assembled bearing assembly for a down drilling motor having a tubular mandrel adapted to connect to a power output of downhole motor, said mandrel having:

an upper end proximal to the downhole motor power output, a lower end with a pin connection distal from the motor, a longitudinal passage through the mandrel from the upper end to the lower end, at least one circumferential ring projecting radially outward from an outer surface of the tubular mandrel, sand ring have and upper shoulder and a slower shoulder and a surface;

a circumferential upper thrust bushing contacting the upper shoulder of the ring;

a circumferential lower thrust bushing contacting the lower shoulder of the ring;

an upper thrust bearing contacting the upper thrust bushing;

a lower thrust bearing contacting the lower thrust bushing;

a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the lower bearing and lower bushing and the upper bushing and upper bearing;

a drilling fluid flow diverter disposed proximal to the upper end of the mandrel;

at least one seal disposed in the lower portion of the bearing housing proximal to the lower end of the mandrel;

a piston sealing assembly disposed proximal to the upper thrust bearing and adapted to prevent drilling mud from entering into the bearing and said piston assembly adapted to inject lubricant into the bearings;

removing the piston sealing assembly and the at least one seal disposed on the lower portion of the bearing housing; and removing the tubular bearing mandrel and replacing of with a shorter tubular bearing mandrel.

15. A downhole drilling motor bearing assembly comprising:

a unitary tubular mandrel adapted to connect to a power output of downhole motor, said mandrel having:

an upper end proximal to the downhole motor power output, a lower end with a male pin connector distal from the downhole motor, a longitudinal passage through the mandrel from the upper end to the lower end, at least one circumferential ring projecting radially outward from an outer surface of the tubular mandrel, said ring having an upper shoulder and a lower shoulder and a radial surface;

an upper thrust bearing disposed above the upper shoulder of the ring;

a lower thrust bearing disposed above the upper shoulder of the ring; and a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the radial surface of the circumferential ring projecting from the mandrel, and said housing adapted to allow the male pin connector of the mandrel to be disposed outside of the lower end of the bearing housing.

16. The bearing assembly of claim 15 further including:

a circumferential upper thrust bushing contacting the upper shoulder of the ring; and a circumferential lower thrust bushing contacting the lower shoulder of the ring;

wherein the upper thrust bearing contacts the upper thrust bushing and the lower thrust bearing contacts the lower thrust bushing.

17. The bearing assembly of claim 15 wherein the bearing housing includes a shoulder disposed between the upper portion and lower portion of the housing and said shoulder is adapted to contact the lower thrust bearing.

18. The bearing assembly of claim 15 further including:

at least one seal disposed in the lower portion of the bearing housing proximal to the lower end of the mandrel; and a piston sealing assembly disposed proximal to the upper thrust bearing and adapted to prevent drilling mud from entering into the bearing, and said piston assembly adapted to inject lubricant into the bearings.

19. A downhole drilling motor bearing assembly comprising:

a tubular mandrel adapted to connect to a power output of downhole motor, said mandrel having:

an upper end proximal to the downhole motor power output, a lower end with a pin connection distal from the downhole motor, a longitudinal passage through the mandrel from the upper end to the lower end, at least one circumferential ring projecting radially outward from an outer surface of the tubular mandrel, said ring having an upper shoulder and a lower shoulder and a radial surface;

a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the radial surface of the circumferential ring projecting from the mandrel; and at least one radial bearing comprising a layer of carbide on at least a portion of the lower portion of the bearing housing and a layer of carbide on at least a portion of the lower end of the mandrel, wherein said layers are adapted to contact one another during rotation of the mandrel within the bearing housing.

20. The bearing assembly of claim 19 further including:

at least one radial bearing comprising a layer of carbide on at least a portion of the upper portion of the bearing housing and a layer of carbide on at least a portion of the upper end of the mandrel, wherein said layers are adapted to contact one another during rotation of the mandrel within the bearing housing.

21. A downhole drilling motor bearing assembly comprising:

a tubular mandrel adapted to connect to a power output of downhole motor, said mandrel having:

an upper end proximal to the downhole motor power output, a lower end with a pin connection distal from the downhole motor, a longitudinal passage through the mandrel from the upper end to the lower end, at least one circumferential ring projecting radially outward from an outer surface of the tubular mandrel, said ring having an upper shoulder and a lower shoulder and a radial surface;

an upper thrust bearing disposed above the upper shoulder of the ring;

a lower thrust bearing disposed above the upper shoulder of the ring;

a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the radial surface of the circumferential ring projecting from the mandrel; and a fluid flow diverter disposed proximal to the upper end of the mandrel to divert a portion of the drilling mud along the outer surface of the mandrel and across the thrust bearings.

22. A downhole drilling motor mandrel catch assembly including:

a unitary tubular mandrel adapted to connect to a power output of downhole motor, said mandrel having:

an upper end proximal to the downhole motor power output, a lower end with a male pin connector distal from the downhole motor, a longitudinal passage through the mandrel from the upper end to the lower end, and at least one circumferential ring projecting radially outward from an outer surface of the tubular mandrel, said ring having an upper shoulder and a lower shoulder and a radial surface;

an upper thrust bearing disposed above the upper shoulder of the ring;

a lower thrust bearing disposed above the upper shoulder of the ring; and a tubular bearing housing having:

a longitudinal passage from an upper end of the housing to a lower end of the housing, said passage having a lower portion with an internal diameter adapted to receive the lower end of the mandrel and said housing having an upper portion with a larger internal diameter adapted to receive the radial surface of the circumferential ring projecting from the mandrel, and said housing adapted to allow the male pin connector of the mandrel to be disposed outside of the lower end of the bearing housing, and a shoulder disposed between the upper portion and lower portion of the bearing housing and said shoulder being adapted to prevent the mandrel from exiting the longitudinal passage in the bearing housing.

23. A method of drilling a borehole includes:

providing an assembled bearing assembly for a down drilling motor having a tubular mandrel with an upper end adapted to connect to a power output of downhole motor, said mandrel having:

an upper end proximal to the downhole motor power output, a lower end with a pin connection distal from the motor, a longitudinal passage through the mandrel from the upper end to the lower end, at least one circumferential ring projecting radially outward from an outer surface of the tubular mandrel, sand ring have and upper shoulder and a slower shoulder and a surface;

a circumferential upper thrust bushing contacting the upper shoulder of the ring;

a circumferential lower thrust bushing contacting the lower shoulder of the ring;

an upper thrust bearing contacting the upper thrust bushing;

a lower thrust bearing contacting the lower thrust bushing;

a tubular bearing housing having a longitudinal passage from an upper end of the housing to a lower end of the housing, said passage having a lower portion with an internal diameter adapted to receive the lower end of the mandrel and said housing having an upper portion with a larger internal diameter adapted to receive the lower bearing and lower bushing and the upper bushing and upper bearing;

a drilling fluid flow diverter disposed proximal to the upper end of the mandrel;

at least one seal disposed in the lower portion of the bearing housing proximal to the lower end of the mandrel;

a piston sealing assembly disposed proximal to the upper thrust bearing and adapted to prevent drilling mud from entering into the bearing and said piston assembly adapted to inject lubricant into the bearings;

connecting a drill string and downhole motor output to an upper end of said tubular mandrel;

connecting a drill bit to a lower end of said tubular mandrel;

inserting the drill string, downhole motor, bearing assembly and drill bit into a borehole;

pumping drilling fluid down the drill string to power the downhole motor;

conducting drilling operations to drill a borehole wherein the drilling fluid is expelled through the drill bit and the sealed thrust bearings are lubricated by the injected lubricant of the piston sealing assembly;

continuing drilling operations after piston sealing assembly fails and allows mud to enter the bearing assembly, wherein the drilling mud that enters the bearing assembly lubricates the bearing assembly sufficiently to continue drilling operations.

* * * * *

UNITED STATES PATENT AND TRADEMARK OFFICE

CERTIFICATE OF CORRECTION

PATENT NO. : 7,549,487 B2
APPLICATION NO. : 11/500012
DATED : June 23, 2009
INVENTOR(S) : Randy LeBlanc It is certified that error appears in the above-identified patent and that said Letters Patent is hereby corrected as shown below:

Title Page:

On the first page, in column 2, Abstract, line 1, delete “beating” and insert -- bearing --, therefor.

On the first page, in column 2, Abstract, line 8, delete “other” and insert -- outer --, therefor.

On the first page, in column 2, Abstract, line 9, delete “and” and insert -- an --, therefor.

On the first page, in column 2, Abstract, line 13, delete “beating” and insert -- bearing --, therefor.

On the first page, in column 2, Abstract, line 20, delete “beating” and insert -- bearing --, therefor.

On the first page, in column 2, Abstract, line 22, delete “beating” and insert -- bearing --, therefor.

In column 9, claim 6, line 19, delete “farther” and insert -- further --, therefor.

In column 10, claim 12, line 67, delete “out the lower end of the bearing housing” and insert -- out of the lower end of the bearing housing --, therefor.

In column 11, claim 13, line 36, delete “out the lower end of the bearing housing” and insert -- out of the lower end of the bearing housing --, therefor.

In column 11, claim 14, lines 53-54, delete “sand ring have and upper” and insert -- said ring having an upper --, therefor.

UNITED STATES PATENT AND TRADEMARK OFFICE

CERTIFICATE OF CORRECTION

PATENT NO. : 7,549,487 B2
APPLICATION NO. : 11/500012
DATED : June 23, 2009
INVENTOR(S) : Randy LeBlanc It is certified that error appears in the above-identified patent and that said Letters Patent is hereby corrected as shown below:

In column 14, claim 23, lines 39-40, delete "sand ring have and upper" and insert -- said ring having an upper --, therefor.

Signed and Sealed this

Twenty-fifth Day of August, 2009

David J. Kappos

David J. Kappos
*Director of the United States Patent and Trademark Office*